US006227301B1

(12) United States Patent
Edwards et al.

(10) Patent No.: US 6,227,301 B1
(45) Date of Patent: May 8, 2001

(54) CHRISTMAS TREE

(75) Inventors: Jeffrey Charles Edwards, Aberdeen; Michael Graham Morgan, Banff, both of (GB)

(73) Assignee: Expro North Sea Limited (GB)

( * ) Notice: Subject to any disclaimer, the term of this patent is extended or adjusted under 35 U.S.C. 154(b) by 0 days.

(21) Appl. No.: 09/171,788

(22) PCT Filed: Jun. 20, 1997

(86) PCT No.: PCT/GB97/01680

§ 371 Date: Jan. 11, 1999

§ 102(e) Date: Jan. 11, 1999

(87) PCT Pub. No.: WO97/49892

PCT Pub. Date: Dec. 31, 1997

(30) Foreign Application Priority Data

Jun. 27, 1996 (GB) ..... 9613467

(51) Int. Cl.[7] ..... E21B 33/035
(52) U.S. Cl. ..... 166/344; 166/368
(58) Field of Search ..... 166/341, 344, 166/347, 368

(56) References Cited

U.S. PATENT DOCUMENTS 3,834,460 * 9/1974 Brun et al. ..... 166/344
4,721,163 * 1/1988 Davis ..... 166/341
4,749,045 * 6/1988 Gano ..... 166/344
4,784,225 * 11/1988 Peterson ..... 166/373
5,213,162 * 5/1993 Iato ..... 166/344
5,873,415 * 2/1999 Edwards ..... 166/344
6,015,013 * 1/2000 Edwards et al. ..... 166/344

FOREIGN PATENT DOCUMENTS

2038906 * 7/1980 (GB) ..... 166/344
2267920 * 12/1993 (GB) .
97/11252 * 3/1997 (WO) .

* cited by examiner

*Primary Examiner*—Eileen D. Lillis
*Assistant Examiner*—Frederick L. Lagman
(74) *Attorney, Agent, or Firm*—Gifford, Krass, Groh, Sprinkle, Anderson & Citkowski, P.C.

(57) ABSTRACT

A Christmas tree (16) is based on a dual bore sub-sea test tree. The Christmas tree consists of a Christmas tree housing (56), which connects to a wellhead (44), a Christmas tree valve block assembly (62) disposed in the housing (56) and a tree cap (84) which connects to the housing (56) and valve block assembly (62). In a preferred embodiment the valve block assembly (62) has a main production bore (70) with two valves (72,74) in series and two auxiliary bores (76,96). One auxiliary bore (96) has a valve (98) for facilitating control of the annulus bore (96) whereas the other annulus bore (76) has no valve and provides a pathway for an electrical submersible cable (66) to a pump. The valves (72,74,98) are actuatable via control from an umbilical (94) and provide the facility to seal the production and annulus access bores to meet statutory requirements. A tubing hanger is not required.

17 Claims, 8 Drawing Sheets

CHRISTMAS TREE

The present invention relates to a xmas tree structure for use in extended well tests. In particular, the invention relates to a simplified horizontal xmas tree structure for use in such tests and to a method of installing such a tree for use in such extended well tests.

Extended well tests (EWTs) are procedures which can last up to 180 days and are carried out in order to assess the viability of a producing reservoir and to obtain accurate reservoir data over a prolonged period. Extended well tests are common for on-shore locations requiring little more than a conventional well test package. Off-shore packages are somewhat different due to tighter regulatory, product and effluent specifications. Due to the extended flow periods, crude oil is normally recovered for commercial sale from the extended well test. Off-shore systems are highly sensitive to well performance because the cost of a rig and export system has to be accounted for. It is of considerable importance to be able to minimise the cost of conducting extended well tests and the apparatus used in the tests without comprising the accuracy of reservoir data or compromising safety.

Extended well tests are typically conducted using a traditional sub-sea test tree and BOP stack. However, if additional wells are also to be tested, or if an injectivity test is to be conducted, it will be necessary to deploy a sub-sea xmas tree to provide well pressure control. For applications in which well testing involves testing more than one well, the term "extended appraisal test" (EAT) is used in place of the term extended well test (EWT). Traditional xmas tree are relatively expensive and require additional accessories and tools such as tubing hangers and tubing hanger running tools and a workover system in order to conduct the extended well test further adding to the rig time and overall cost of conducting the well test.

An object of the present invention is to provide a pressure control system embodied in a simplified structure and a method of its deployment which obviates or mitigates at least one of the disadvantages associated with existing xmas trees.

This is achieved by providing a simplified xmas tree based on a dual bore sub-sea test tree. A separate tubing hanger is not required and the main bore of the sub-sea test tree is used as the production bore. In a preferred embodiment, an axial bore, which includes an isolation valve, is provided for communication with the well annulus and an additional axial bore is occupied by an electrical power cable for supplying an electrical submersible pump (ESP).

According to a first aspect of the present invention there is provided a xmas tree for use in a variety of well applications, said xmas tree comprising:

a generally cylindrical xmas tree housing defining a generally cylindrical bore, a separate xmas tree valve disposed within the cylindrical bore of said xmas tree housing and engaged with the xmas tree housing, and a xmas tree cap for engaging with said valve block, or said xmas tree housing, the xmas tree cap being coupled to a rig via various flowline and umbilical services to facilitate control of the xmas tree in conveying fluids between surface mounted process facility and a downhole reservoir, the xmas tree valve block having a main production bore and at least one auxiliary bore, the main production bore having at least two valves axially spaced therein, said valves being operable to seal the bore and provide well barriers, said at least one auxiliary bore providing an annulus access bore and containing a single valve operable to seal the access bore and provide a well barrier in the annulus.

Conveniently, the xmas tree valve block has a main production bore and two auxiliary bores. One auxiliary bore provides the annulus access bore and has a valve therein and the other auxiliary bore has no valve but is used for receiving a power cable for driving an electrical submersible pump.

In the absence of a requirement for an electrical submersible pump, no power cable is used and a single axial bore for the cable is provided or, if two bores are present, the additional bore is blocked and sealed. A single axial annulus access bore is provided for providing annulus control regardless whether or not there is a power cable disposed in said auxiliary bore.

It will also be appreciated that each of the bores has sealing means to seal the bores so that leakage of fluid from the bore is prevented when the tree cap is made up to the valve block and/or valve housing.

Preferably also, said valves in series within said production bore and the annulus bore are ball valves. Alternatively, said valves are flapper valves, disc valves or plug valves.

Preferably also, the housing engages with a standard wellhead connector to enable it to be attached to a sub-sea wellhead and the valve block is proportioned and dimensioned to fit in within the bore of this housing and the housing is adapted to be received by the tree cap so that connection is made between parts of the production bore, and parts of the two auxiliary bores to provide effective connection for these bores. The connections in the production and annulus bore are hollow pin and socket connections. The connections in the bores for electrical communication are of a wet mateable connection in the power and signal cables. The connections in the controls parts are also by hollow pins and sockets.

Conveniently also, locking means are provided between the xmas tree housing and the valve block assembly which are actuated when the tree cap fits on to the valve block to lock the valve block to the xmas tree housing, and to provide fine alignment between the tree cap and the housing. Conveniently, the locking means are radially acting dogs which are actuated by axial movement of a ring within the tree cap locking means. The top surface of the upper end of the valve block, which is level with the top of the housing, is provided with profiles to accommodate:

1) the sealing of the production and annulus bores,
2) the sealing of the hydraulic ports required for the control of the actuation of xmas tree and other well functions,
3) repeatable make and break of connections in the communications of electric signals between the surface and the electrical equipment located within the well,
4) repeatable make and break of connections in the communications of electrical power between the surface and electric submersible pump.

The external surface of the upper end of the valve block is provided with at least one shaped keyway to ensure correct angular alignment between the xmas tree and the tree cap to facilitate correct engagement of the various connections at the top surface of the tree cap as described above.

Conveniently also, the xmas tree housing may be coupled to a guide frame which is adapted to guide and receive the tree cap when installed so that there is effective and efficient coupling between the tree cap and the tree housing and valve block. The guide base is fitted to the wellhead system, and a protective frame is attached to the tree housing which takes the guidance from the wellhead, into the tree, and hence into the tree cap.

A permanent guide base, attached to the wellhead system, including a side guide frame with guidepost spacing of the same dimensions as the guide frame coupled to the wellhead so that when the tree cap is removed for workover mode, the tree cap can be moved to one side and parked adjacent to the wellhead.

According to another aspect of the present invention there is provided a xmas tree structure comprising:

a xmas tree housing coupled to a sub-sea wellhead;

a xmas tree valve block located in said xmas tree housing, said xmas tree valve block having a production bore with at least two valves disposed in series and at least one auxiliary bore for facilitating annulus access control, said at least one auxiliary bore having a valve therein, a xmas tree cap coupled to the xmas tree valve block and to said xmas tree housing, locking means disposed in said xmas tree to fasten the xmas tree housing, xmas tree valve block and said xmas tree cap together, said respective xmas tree valves being remotely operable to be selectively moved between open and closed position to control flow or liquid through said xmas tree structure.

Conveniently, there are two auxiliary bores; one annulus access bore and a further auxiliary bore with at least one valve therein and a further auxiliary bore for receiving a power cable for supplying power to a downhole electrical submersible pump (ESP).

According to a further aspect of the present invention, there is provided a method of installing the xmas tree on a wellhead for use in a variety of well tests, the tree housing having a blow-out preventer means initially coupled thereto in place of a tree cap, said method comprising the steps of:

a) providing a xmas tree housing coupled to the wellhead, the xmas tree housing having a top part adapted to be coupled to the blow-out preventer connector, b) running a xmas tree valve assembly through said BOP stack for engaging with the xmas tree housing and being operable for providing a well barrier to the flow of well fluid, c) closing the well barrier to provide well isolation once the xmas tree valve assembly is located in said xmas tree housing, d) removing the blow-out preventer stack from the xmas tree housing, e) running in a xmas tree cap and securing the xmas tree cap to the xmas tree housing and xmas tree valve assembly to provide coupling from the production and annulus bores to the surface and from auxiliary ports and bore to the surface, the arrangement being such that the valves in the production and annulus bores can be controlled to provide control of well fluid and xmas tree functionality.

Preferably also, the method includes the step of using the xmas tree in a workover mode, said method including the additional steps of removing the xmas tree cap and parking the xmas tree cap on a further guide frame adjacent to the wellhead and xmas tree housing, and coupling a blow-out preventer stack on top of said xmas tree housing with said xmas tree assembly contained therein.

These and other aspects of the invention will be better understood from the following description when taken in combination with the accompanying drawings in which.

Figure 5:
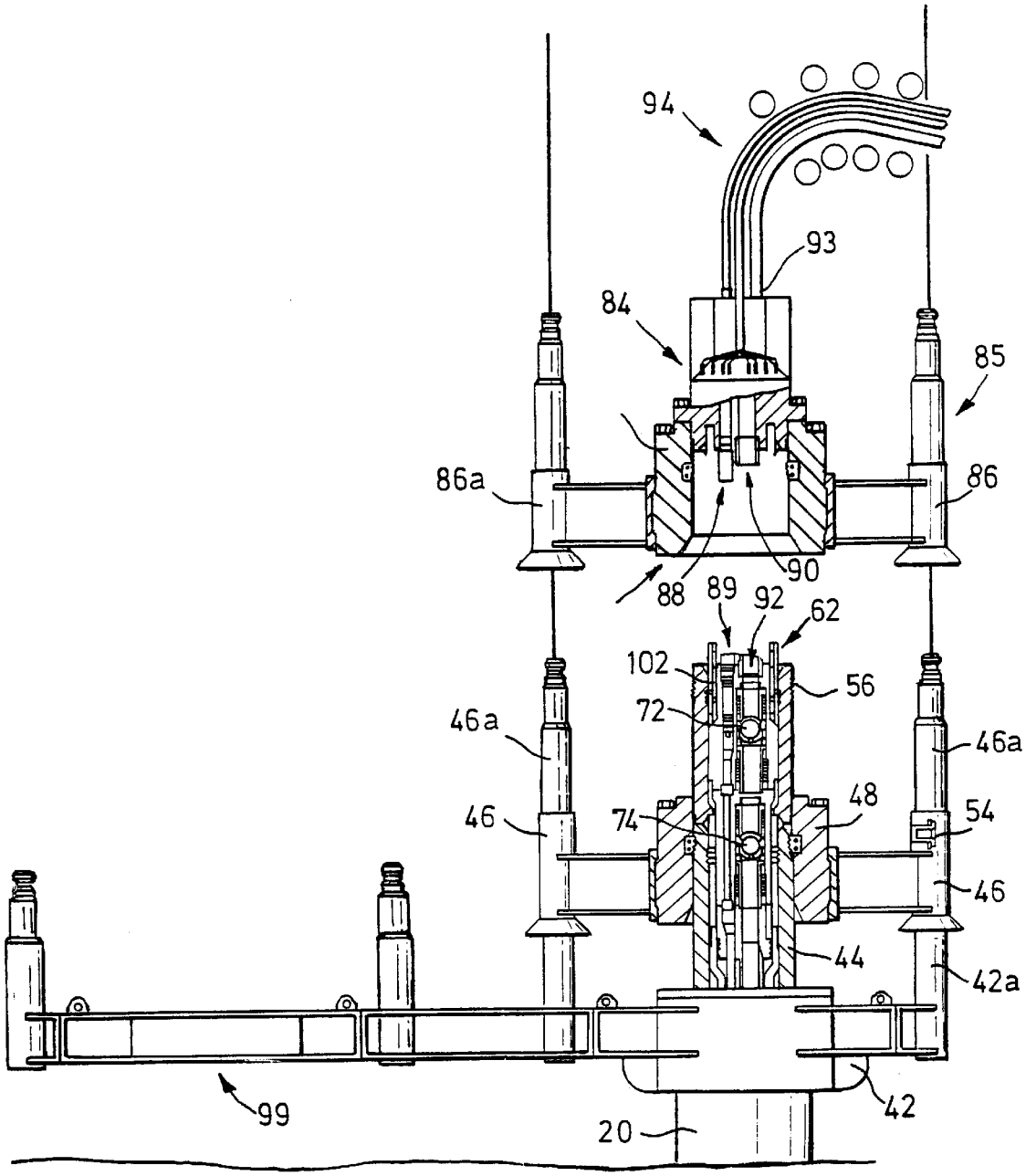
FIG. 5 shows a view similar to FIG. 4 with the BOP stack removed and a simplified xmas tree in accordance with the embodiment of the present invention being completed by the installation of a xmas tree cap.
Figure 6A:
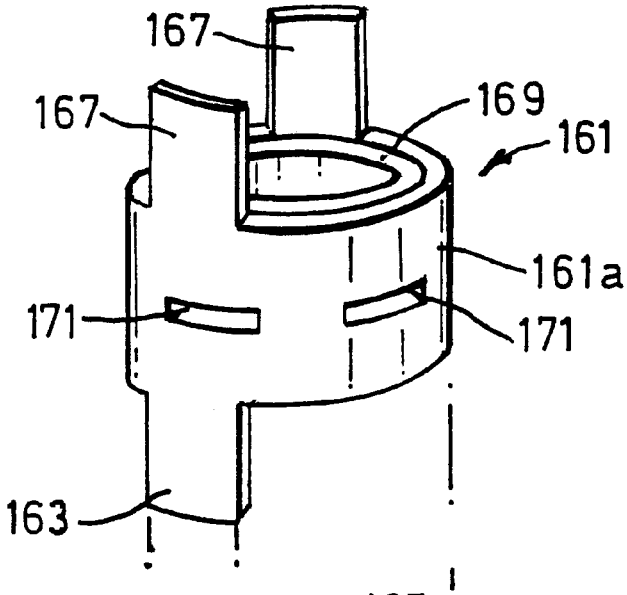
Figure 6B:
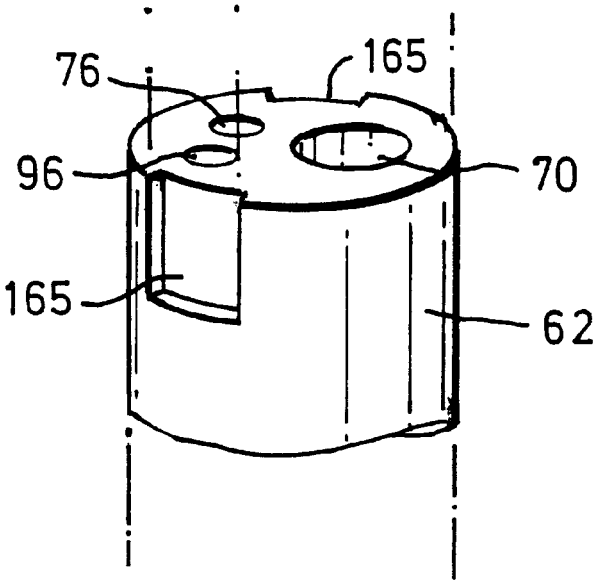
Figure 6C:
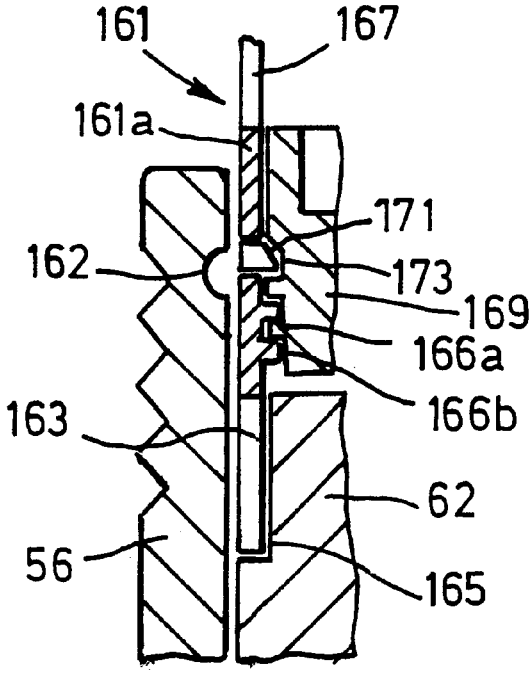
Figure 8:
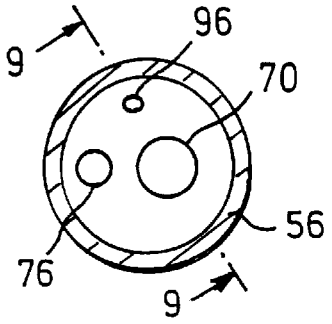
Figure 9:
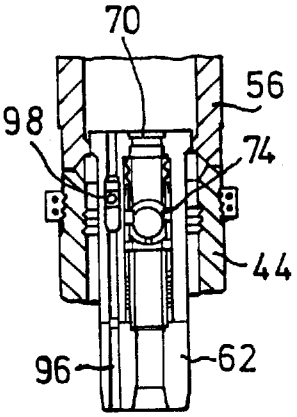
Figure 7:
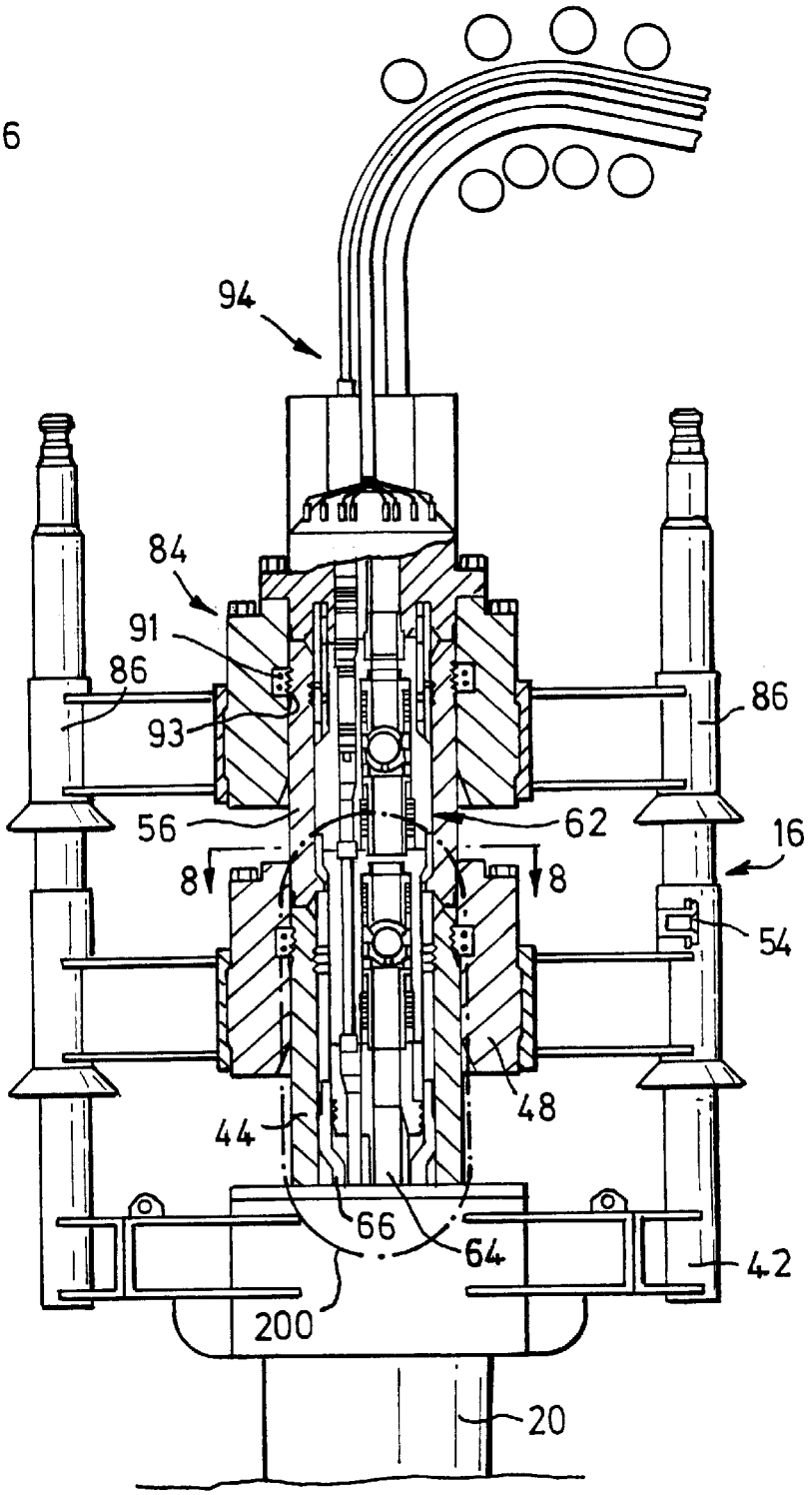
Figure 10:
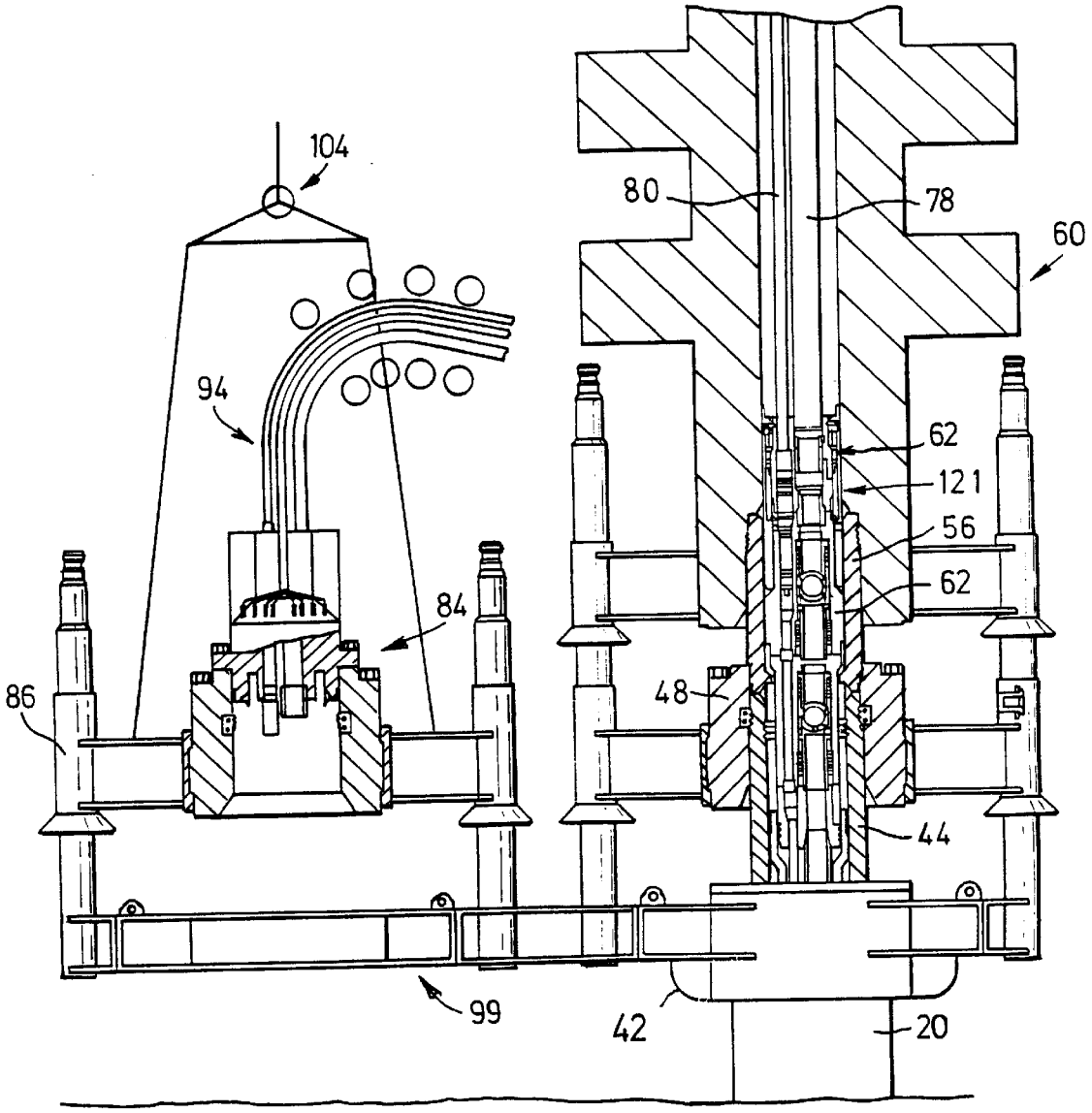

FIGS. 6*a* and 6*b* are respective perspective views of a lockdown assembly and part of a valve block respectively for locking down the valve block and providing fine angular alignment from the block to the xmas tree cap;

FIG. 6*c* is an enlarged part section through the lockdown assembly located within the xmas tree housing;

FIG. 7 is a view similar to FIG. 5, but drawn to a larger scale, in which the xmas tree cap is shown coupled to the xmas tree housing to define a complete simplified xmas tree ready for in production mode with the flow line controls and umbilical attached to the xmas tree cap;

FIG. 8 is a sectional view taken on the line 8—8 through the structural housing of FIG. 7;

FIG. 9 is a detail of part of the dual bore tree shown in FIG. 7 and taken on the lines 9—9 of FIG. 8 to demonstrate the second auxiliary bore, providing communication with the annulus and showing the production and annulus bores with isolation valves, and FIG. 10 is a view of the extended well test xmas tree in workover mode where the xmas tree cap has been removed and parked adjacent to the permanent guide base (PGB) and a BOP stack is connected to the structural housing.

Figure 1:
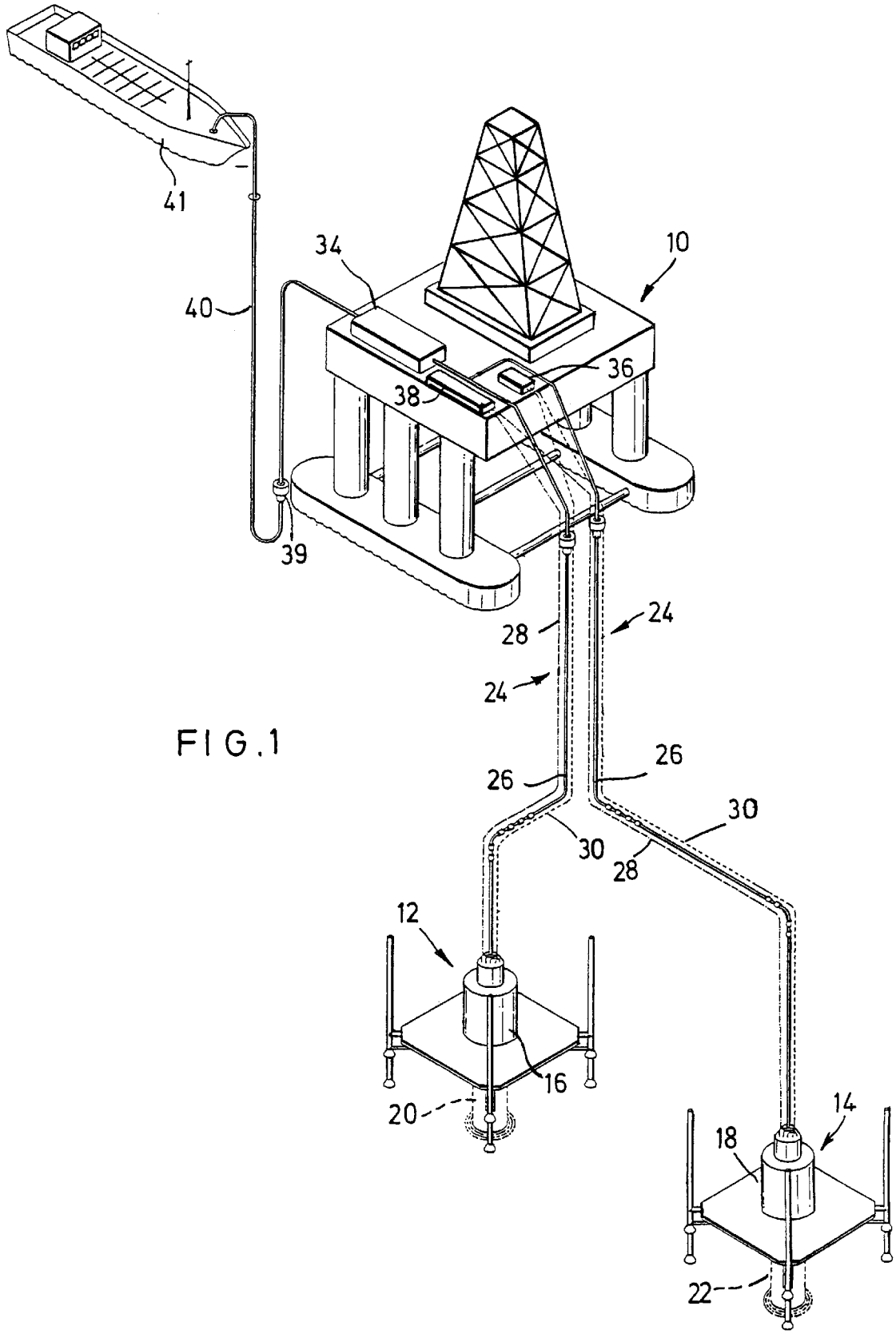
FIG. 1 depicts a diagrammatic representation of a semi-submersible rig coupled to two EAT trees (extended appraisal test tree) simplified xmas trees in accordance with an embodiment of the present invention shown mounted on wellheads.

Reference is first made to FIG. 1 of the drawings which is a diagrammatic illustration of an extended appraisal test (EAT) tree from a semi-submersible rig 10 in which there is simultaneous production from two separate wells 12,14.

Wells 12 and 14 have associated extended appraisal test (EAT) tree simplified horizontal xmas trees 16,18 which are located on respective wellheads 20 and 22. A horizontal tree is one in which the completion can be pulled out of the well without the need to recover the tree. Each xmas tree 12,14 is coupled to the semi-submersible 10 via various lines, generally indicated by reference numeral 24, a flexible production riser 26, an electrical power cable 28 and a controls umbilical 30. The umbilicals are connected to a respective rig-mounted process system 34, control system 36 and electrical power distribution system 38 via rig-mounted EQDC (Emergency Quick Disconnect/Connect) units. Liquids which are produced during the extended well test passes through the process system, and oil is pumped to a tanker 41 via EQDC 39 add export line 40.

The simplified xmas trees 16,18 on the wellheads, which will be later described in detail, are based on a dual bore sub-sea test tree and allow an extended appraisal test (EAT) to be conducted without the expense and complexity associated with traditional xmas trees.

Figure 2:
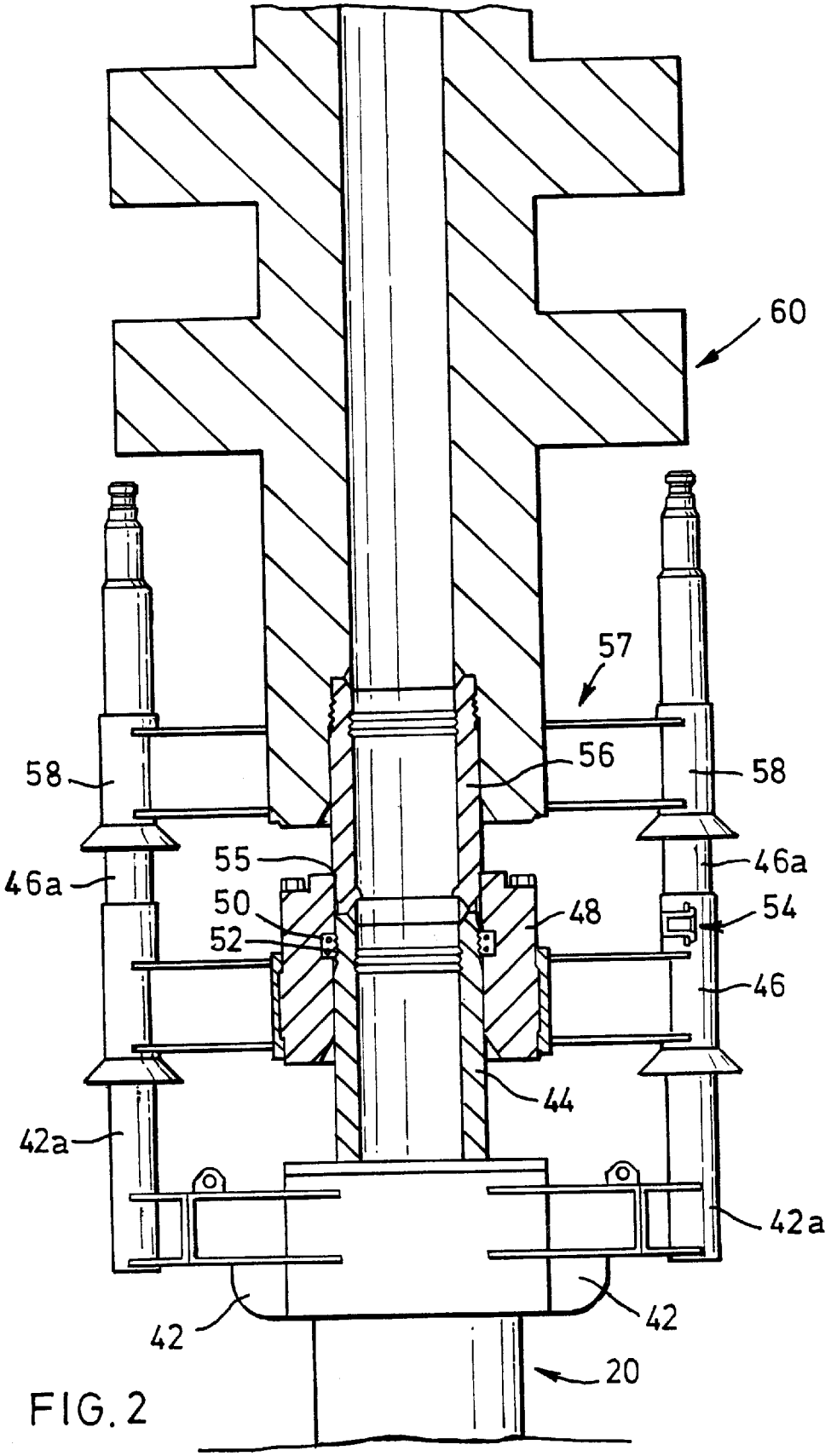
FIG. 2 is a sectional elevational view through part of a simplified horizontal xmas tree housing in accordance with an embodiment of the present invention installed on a wellhead with a BOP stack shown coupled to the xmas tree.

Reference is now made to FIG. 2 of the drawings which is an enlarged scale sectional elevation through the wellhead and the EAT xmas tree 16 which consists of a xmas tree housing installed on a wellhead with a blow-out preventer BOP attached to a structural housing. For convenience, only the simplified xmas tree 16 will be described in detail although it will be understood that xmas tree 18 has the same structure and operates in the same way. Mounted on the conductor housing 20 of the wellhead system is a four post permanent guide base (PGB) 42 which surrounds 18¾" high pressure wellhead 44. A guide frame 46 fitted with four funnels to capture the PGB guide posts 42*a* is coupled onto the xmas tree housing connector 48 which has dogs 50 which engage with an exterior profile 52 on the wellhead 44 to securely fasten the guide frame 46 and tree connector 48 to the wellhead 44. The wellhead connector 48 has a connection point 55 for receiving a structural xmas tree housing 56 as shown in FIG. 2. An internal cam profile (not shown) is provided at a pre-determined angular orientation with respect to the guide frame 42, to engage a key on the valve block to control the angular position of the valve block in relation to the PGB 42, in order to achieve correct landing of the tree cap. A BOP stack 60 also having a guide frame 57, with funnels 58 which receive the posts 46*a* of frame 46, is shown mounted on the xmas tree housing 56. The arrangement of FIGS. 2, 3 and 4 depict the installation or workover mode as compared to extended well test mode.

As mentioned above, a conventional type of horizontal tree wellhead is expensive and it also requires that the tubing hanger is run prior to use of the wellhead.

Figure 3:
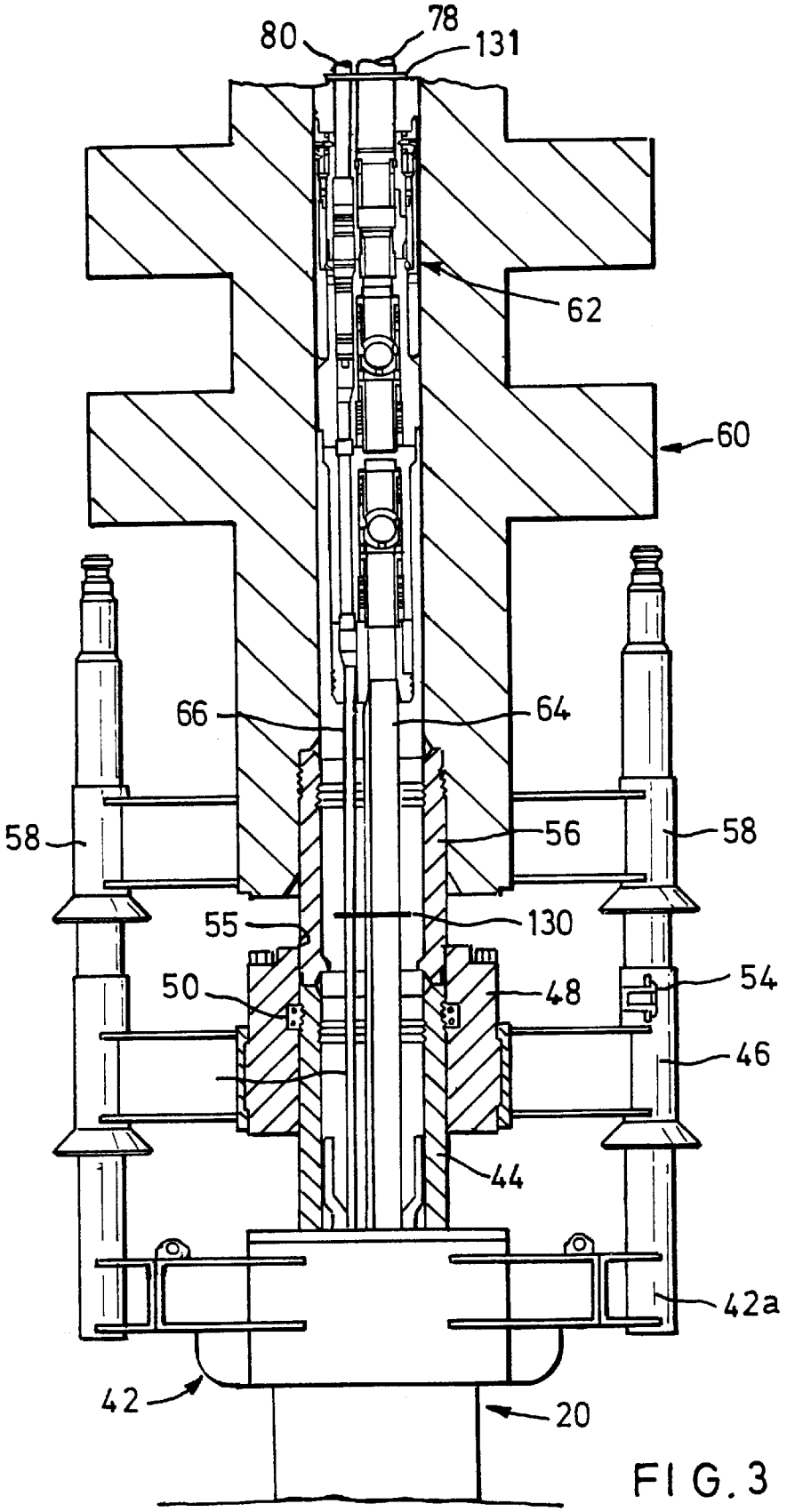
FIG. 3 is a view similar to FIG. 2 but depicts an insert tree valve block being installed through the BOP stack into the xmas tree housing.

This is overcome using the arrangement shown in FIG. 3 in which an insert xmas tree valve block, generally indicated by reference numeral 62 is installed through the BOP 60 into the xmas tree housing 56. In this case it will be understood that the insert tree valve block 62 is based on a dual bore sub-sea test tree (similar to the type disclosed in applicant's co-pending International Published Application No. PCT/GB96/01115) which carries at its lower end tubing 64 and an electrical cable 66 which is coupled to an electrical submersible pump (ESP), not shown in the interest of clarity. The installation procedure for the insert xmas tree valve block 62 will be later described but it is sufficient to note that at present, with reference to FIG. 3, the valve block 62, including the tubing 64 and the cable 66 which it is carrying, passes through the BOP stack 60 and the xmas tree housing 56.

Figure 4:
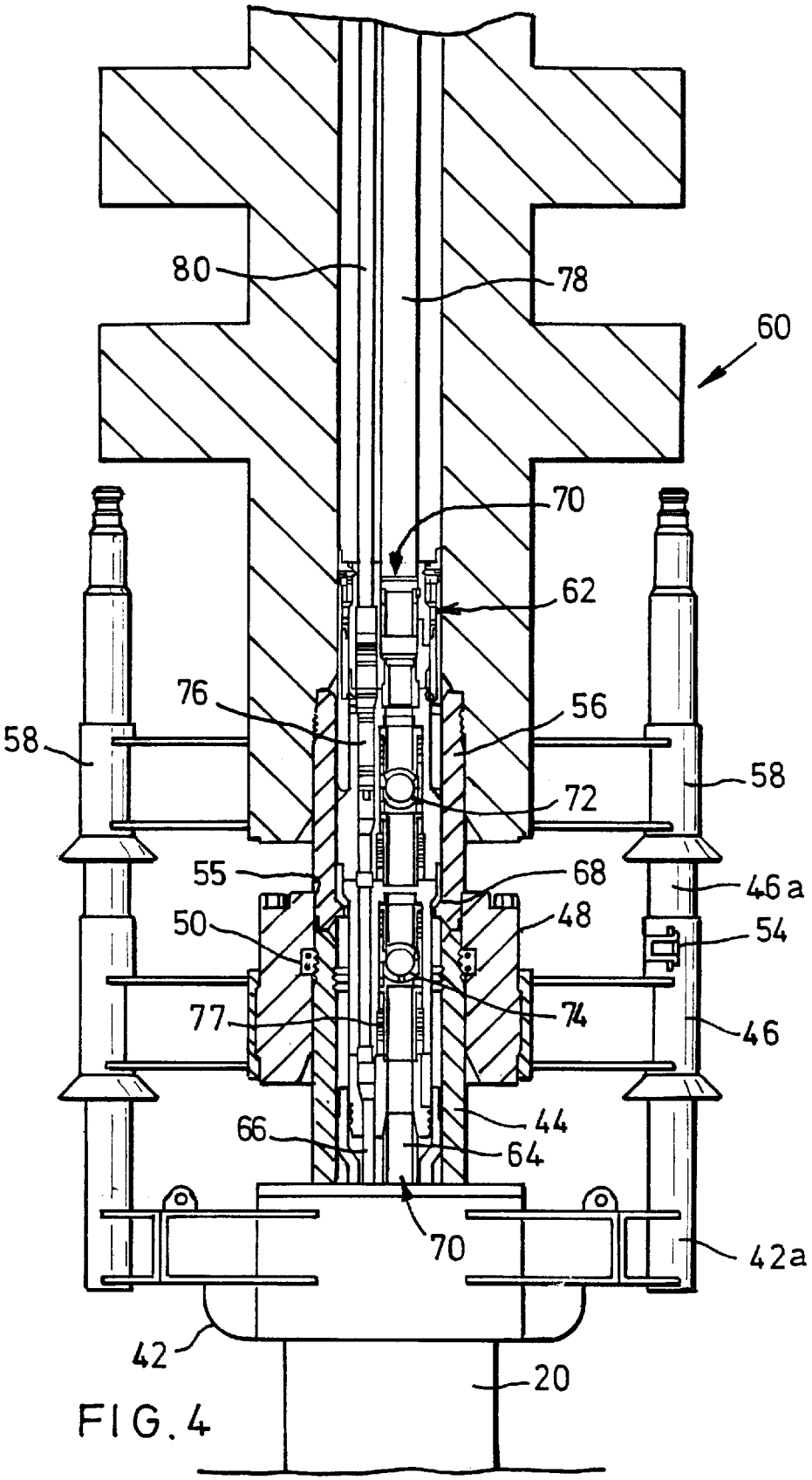
FIG. 4 shows the insert tree valve block of FIG. 3 landed within the xmas tree housing.

Reference is now made to FIG. 4 of the drawings which is similar to FIG. 3 except that the insert tree valve block 62 has been landed on an annular landing shoulder 68 within the structural housing 56 whereby it adopts the position shown in FIG. 4; that is, part of the xmas tree valve block 62 extends upwardly from the xmas tree housing 56 inside the BOP stack 60. It will be seen that the main bore 70 of the valve block 62 contains two 5" ball valves 72,74 in series similar to the sub-sea test tree and, as shown in FIGS. 8 and 9, a smaller single valve 98 in the annulus bore 96, and an auxiliary 2" annulus bore 76 provides a pathway for the electrical submersible cable 66. The ball valves 72,74 are qualified to a relevant xmas tree design standard, for example AP1 17D. It will be understood that the xmas tree ball valves are uni-directional sealing valves which may be used in a bi-directional application if required. Each ball valve 72,74 is "failsafe closed" fitted with a spring package 75,77 respectively to return the valve to the closed position on loss of control pressure. This is designed to give a valve closure time of approximately 30 seconds. Each ball valve has a double acting hydraulic actuator (not shown in the interest of clarity) whose axis is coincident with the axis of flow through the valve. This means that pressurised hydraulic control fluid can be applied to either the open or the closed side of the actuator. For a uni-directional sealing application, a single control line conveys pressurised control fluid to the open side of the actuator. This opens the valve against spring force, which spring force returns the valves to the closed position, on cessation of the application of pressure maintaining the valve in the open position. It will also be appreciated from FIG. 4 that the xmas tree valve block 62 is run on a casing riser 78 and the electrical cable connection is made via a power cable 80. An umbilical (not shown in the interest of clarity) contains a bundle of tubular conduits for the conveyance of control fluids, and for communication with the well annulus. The xmas tree housing 56 has the annular landing shoulder 68 for receiving the xmas tree valve block 62 as shown and when the valve block 62 is in the position as shown in FIG. 4, it is then in the correct position. Once the xmas tree valve block is installed, the ball valves 72,74 and 98 can be actuated to a closed position to provide well control barriers in the main bore 70, and the annulus bore 96 also as shown in FIG. 4, and the BOP stack 60 can then be removed.

Reference is now made to FIGS. 5 and 6*a, b* and *c* of the drawings; FIG. 5 depicts installation of the xmas tree cap, generally indicated by reference numeral 84, after the BOP stack 60 has been removed, and FIGS. 6*a*,6*b* depict the separate parts of a lockdown assembly by which the tree cap 84 is accurately aligned orientationally to the valve block 62 and xmas tree housing 56 and FIG. 6*c* depicts the lockdown assembly located within the xmas tree housing 56.

The EAT tree cap connector 83 is mounted in a tree cap guide frame 85 which has four guide frame funnels 86 (only two of which are shown) so that when it is run, as shown in FIG. 5, the funnels 86 mate with the guide posts 46*a* of guide frame 46, thereby providing coarse alignment between the tree cap connector 83 and the xmas tree housing 56 and tree valve block 62. It will be seen that the tree cap connector 83 is a central perforated cylindrical block within a conventional externally attached wellhead connector, and which is of a similar structure to the wellhead connector 48, and locks to the structural housing 56 in the same way as the wellhead connector 48 connects to the wellhead 44. Once the valve block 62 has been landed within the housing 56 a lockdown assembly 161, shown in FIG. 6*a,* is installed. This has an expanding profile which engages a suitable internal profile 162 in the housing and, when set, locks the valve block 62 in the housing 56 in order to prevent its upwards movement due to well pressure acting on closed valves 72,74 within the valve block 62. The lockdown assembly 161 has an outer body 161*a* and a rotatable and axially movable, via engagement of threads 166*a,b* (FIG. 6*b*), inner ring 169 for locking the assembly to the housing 56, as will be later described, outer body 161*a* has lower keys 163 (one of which is shown) which engage shaped keyways 165 on the external surface 167 at the upper end of the valve block, and similar upper keys 167 engage corresponding keyways 159 in the tree cap 84, to provide fine alignment to ensure the engagement of the hollow pins and sockets, in the connections in the halves of the production and annulus bores, the power and the signal electrical connectors and the controls connections, between the tree cap 84 and the insert valve block 62 as will be described below. The assembly is run in and landed with the lower protruding keys 163 engaged with the keyway 165 in the valve block 62. As best seen in FIG. 6*c,* rotation of the inner body 169 expands dogs 171 to lock into a housing groove 162. With the dogs 171 engaged, further downward travel of the inner body 169 contacts the valve block 62 to rigidise it in place within the tree housing 56. As shown in FIG. 5, the tree cap connector 83 has parts which mate with the valve block including the upper part of wet mateable connectors, generally shown by numeral 88, for making the connections in the electric signals and power to downhole equipment, generally shown by numeral 89, and hollow, pins, generally indicated by numeral 90, for connection with the sockets in the production, annulus and controls ports bores generally shown by numeral 92. It will be seen that the top 90 of the tree cap 84 contains a termination 93 for the flow line and controls umbilical. It will also be seen from FIG. 5 that the permanent guide base 42 has a side extension, generally indicated by reference numeral 99, of the same configuration as the guide base 42 for receiving the xmas tree cap 84 from the xmas tree housing 56 in order to accommodate a workover operation which requires a BOP stack to be installed on the tree housing.

Reference is now made to FIGS. 7 and 9 of the accompanying drawings which depicts the assembled simplified xmas tree 16 based on the xmas tree valve block 62 for providing control of reservoir fluids. The tree cap 84 is mounted on the xmas tree housing 56 with dogs 91 engaging the exterior profile 93 in the same way as the BOP stack 60 was connected. When xmas tree is assembled there is connection between the parts of the main production bore 70, the annulus bore 96 and auxiliary bore 76. In this arrangement, which is the production mode, it can be seen that the flow line and umbilicals, generally indicated by reference numeral 94, are attached to the tree cap 84. It will also be seen in FIGS. 7 and 9 that the 5" ball valves 72,74, and 1½" valve 98 are shown in the closed position. However, it will also be appreciated that they may be actuated via the umbilical 94 from surface to open positions to permit reservoir fluid to flow through the main production bore 70, and to monitor pressure in the annulus bore 96. The electrical power cable 66, which passes through the auxiliary bore 76, allows power to be supplied from the surface to the downhole electrical submersible pump.

FIG. 8 depicts a section through the xmas tree housing 56 on line 8—8 of FIG. 7 and it will be seen that there are three principal axial bores in the insert valve block (control axial bores have been omitted for clarity); the main 5" production bore 70 which has the two ball valves 72,74 in series, the 1½" annulus access bore 96, and the 2" auxiliary bore 76, which receives the electrical power cable 66 coupled to the downhole electrical submersible pump.

Reference is also made to FIG. 9 of the drawings which is a sectional view taken along the lines 9—9 of FIG. 8 and shows a partial sectional elevation of the tree showing through a detail 98 (shown in broken outline) of the xmas tree 16 of FIG. 7, depicting the production and annulus access bores 70,96 each with an isolation valve 74,98 (with the tubing omitted for clarity). It will be appreciated that with this structure, control of the annulus line 96 will be carried out in the same way as using the dual bore sub-sea test tree with the resulting advantages also being present in this arrangement.

Reference is now made to FIG. 10 of the drawings which shows the xmas tree 16 in workover mode with the tree cap 84 removed and the flow line and umbilicals part 94 parked on the extended guide base 99 disposed adjacent to the permanent guide base 42 and with the BOP stack 60 run to again mate with the xmas tree housing 56 in the same way as shown in FIG. 4 of the drawings.

It will be appreciated that the xmas tree valve block 62 is run on the riser 78 as if it were a sub-sea test tree and landed on the annular landing seat 68 within the xmas tree housing 56. It will also be appreciated that because the xmas tree valve block 62 interfaces with its deployment tool 121, and the xmas tree cap 84 having multiple axial penetrations, it must be installed in a known orientation to the permanent guide base guide posts 46 in order to ensure correct engagement with the tree cap 84 and the electrical power connector and the usual seal subs. The orientation alignment between the tree 16 and the tree cap 84 is achieved in step-like fashion with each successive step controlling more closely the alignment.

As described above, rough alignment is established between the tree guide frame funnels 58 and the post on the PGB guide frame posts 46*a,* and immediate alignment is established with the installation of the xmas tree valve insert block 62 into the housing 56. Fine alignment is set up with the installation of the lock-down assembly (161) in preparation for the alignment required for the installation of the tree cap 84.

The insert valve block 62 is provided with means of achieving correct alignment. As described above with reference to FIGS. 6*a* and 6*b,* the keyways 165 on the external diameter of block 62 facilitates engagement with keys 167 and orientational alignment of the latch/running tool. Similarly, at the bottom end, an orientational alignment key (not shown) is fitted to the xmas tree insert valve block 62 which interacts with an internal bi-directional cam profile (not shown) within the lower end of the cylindrical xmas tree housing 56. The angular relationship between the orientational aids or main set valve block 62, the keys at the top and the orientation key at the bottom are controlled.

The lock-down mechanism, or assembly 161 is run in to rigidise the valve block 62 in place and also provides a fine orientational alignment. As described above, with reference to FIGS. 6*a* to 6*c,* the underside of the lockdown mechanism 161 carries the same key profile 163 as the valve block 62, whereas an upward facing key 167 at the top of the lock-down mechanism 161 provides a precision location for a matching keyway within the tree cap 84.

The aforementioned structure and overview of installation and operation will give the reader an understanding of the structure and the installation procedure. However, for a better and more complete understanding regarding the running of the EAT xmas tree 16, it will be understood that prior to and during the running of the completion, the tree components are tested for function, orientation and pressure integrity using a tree stump/shipping skip. It is anticipated that drilling is carried out conventionally with the BOP stack 60 located directly on the wellhead 44 which may be of a conventional type, for example Vetco SG-5 H-4.

A brief summary of the sequence of events regarding the running of the EAT simplified xmas trees 16,18 is as follows:

a) At the end of the drilling phase, the well is suspended conventionally with the appropriate plugs/suspension string. The BOP 60 is pulled and a wellhead corrosion cap (not shown) installed and the PGB guidelines are disconnected and retrieved.

b) In the event that a rig and completion equipment are available for installation of the completion immediately after drilling, it will be understood that the trip to run the corrosion cap may be eliminated.

c) The xmas tree housing 56 is then run using the running tool available from the drilling phase and is locked on the wellhead 44 using either a workover (W/O) umbilical attached to the hydraulically operated wellhead connector by using a ROV "hot stab" connection system stabbed into a suitable receptacle on the guide frame of the xmas tree spool housing 56. The workover umbilical may then be disconnected using the ROV.

d) The BOP stack 60 is then run in the conventional way on marine riser.

e) Once the BOP stack 60 is run and is in position, as shown in FIG. 2, the running tool is used to run in the hole and test the VX seal, the running tool being available from the drilling phase and being fitted with a cup tester which seals the top of the production casing or the casing hanger in the wellhead.

f) Once the VX seal has been tested, the running tool and cup tester is pulled from the hole.

g) On surface the electrical submersible pump (ESP) is made up to the completion tubing and packer, the downhole chemical controls line is made up and the ESP is then run in the hole on 7" tubing/casing with the electrical power cable and controls line being unreeled and strapped to the production tubing as necessary until the correct length of production tubing has been run in the hole.

h) The xmas tree valve block 62 will already have been made up to its running tool 121, FIG. 10, on the surface and will have been stored (racked) back in the derrick. This valve block 62, the running tool 121 and the umbilical 80 are now made up to the string 78. The downhole electrical cable 66 cut and terminated at the termination point 130,131, FIG. 3, to tails from the wet mate connector halves 88,89 at the tree cap 84 and the xmas tree valve block 62 and tested for continuity and function.

i) Assuming that the continuity and function is acceptable, the xmas tree valve block 62 is run in the hole and production tubing and landed in the xmas tree housing 56 as shown in FIG. 4. In this position the ESP can be tested as required.

j) The xmas tree valve block running tool 121, the running string and umbilical 80 are then retrieved from the hole.

k) The lockdown assembly 161 and running tool not shown are picked up and run in the hole on tubing or drill pipe and the valve block 62 is then rigidised within the xmas tree housing 56 by turns of right hand rotation of the lockdown assembly running tool and thereafter the lockdown assembly running tool is retrieved from the hole.

As described above, the tree cap 84 is run with the flow line, the umbilical and the electrical power cable attached to the tree cap, which all need to be pulled out from storage drums located on the rig deck or on an adjacent vessel. Once these "flexible members" have been unreeled from the respective storage drums, the free ends are delivered and connected to the EQDC system. It is necessary to have installed "keel haul" lines from the storage reel locations into the moonpool area in order to deliver the ends of the flexible members to the moonpool for attachment to the xmas tree cap 84.

The xmas tree cap 84 is positioned on the spider beams (not shown in the interests of clarity) in the moonpool of the vessel and the respective connections of the flow line, umbilical and electrical power cable 94 are made up to the xmas tree cap 84 with the required bend restrictors, strapping and buoyancy modules being installed as required.

Thereafter, the connection is made up to the tree cap running tool 104, the spider beams are spread and the xmas tree cap 84 picked up and run in to land it on the xmas tree housing 56 as shown in FIG. 7 with the flexible members being strapped together at the various locations along their length as necessary.

Once in the position shown in FIG. 7, the tree cap connector 84 is locked in place using alternative procedures described above for running the structural housing 56 and the system is tested. The tree cap running tool 104 is then retrieved.

It will be appreciated that the tree may be retrieved using steps which are basically the reversal of the running in steps.

The workover procedures are similar to the retrieval procedures except that the tree cap 84 is not recovered to the surface provided that it is still functional. The tree cap running tool 121 is run, the tree cap connector is released and the tree cap 84 lifted off the tree 62. A ROV is mobilised to disconnect the guidelines which are fitted with ROV releasable post tops of a proprietary manufacturer (such as Regan GL4).

As best seen in FIG. 10, the tree cap 84 is skidded to one side, similar to running the BOP stack 60, and the guidelines are reconnected to a second set of posts of guide frame 92 adjacent to the normal side posts 46, thereby forming a "parking bay" adjacent to the well attached to the existing permanent guide base 46. The tree cap 84 is set down over the posts of the parking bay and the tree cap running tool 104 disconnected and retrieved to the surface. The ROV is remobilised to effect reconnection of the guidelines back to the well guide post tops.

This allows the BOP stack 60 to be re-run to land on the structural housing 56 of the tree, as shown in FIG. 10, and the completion and ESP can be pulled as a normal retrieval operation. It will also be appreciated that the tree cap can be replaced as a reversal of the foregoing steps.

Various modifications may be made to the simplified xmas tree hereinbefore described without departing from the scope of the invention. For example, the preferred embodiment describes a xmas tree with an auxiliary channel which receives a cable for use with an electrical submersible pump. However, it will be understood that the system could equally well be used in a well with natural drive in which case a conventional sub-sea test tree may be used as a valve block with the annulus line performing its normal annulus path function. It will also be understood that the ball valves may be replaced by any other type of suitable valves, such as flapper valves, which are sufficient to provide a sealing function in the production bore and the annulus bore. It will be understood that a single valve may be used in the xmas tree bore but, for safety reasons, two valves in series are preferred in the production bore, although a single valve in the annulus bore is adequate.

It will also be understood that various diameters of xmas tree housings and xmas tree valve blocks may be used. However, it will be understood that the xmas housing of 18¾" nominal bore diameter which is the same as that of the wellhead is particularly convenient and is designed to receive a valve block assembly and machined in accordance with the diameter of a typical 5"×2" sub-sea test tree. It will be appreciated that the dimensions of the bore and length of the tools may be varied in accordance with specific requirements and that the dimensions hereinbefore described are exemplary only.

The connection between the xmas tree cap and the xmas tree housing may be other than using a wellhead type of connector as hereinbefore described. Any other suitable connector may be used which gives an appropriate sealing function which is sufficient to comply with the safety requirements and it will be understood that the tree cap connector and structural housing connection which simulates the wellhead and wellhead connector arrangement is particularly convenient as these products already exist aid have been well tested.

In the event of a requirement to test the tree valves from above, a second control line is required to convey pressurised control fluid to the closed side of the actuator. This creates an upward force which counteracts the hydrostatic pressure acting downward on the ball from above, and maintains contact between the ball and the seat to prevent leakage, thus facilitating the test of the valve from above, if so required.

It will also be understood that although the preferred used of the simplified xmas tree structure is an extended well test, it will nevertheless be understood that the xmas tree may be used in an early production facility or even a permanent production facility and also for water and gas injection operations where relatively quick and straightforward access to a well is required without requiring the considerable expense of a traditional xmas tree.

Advantages of the simplified xmas tree in accordance with the present invention are that the structure can be readily and quickly installed and is capable of being used in a variety of well applications, such as extended well tests, extended appraisal tests and early production facility and gas and water injection. The xmas tree uses many existing well components thereby minimising the cost and also utilises a dual bore sub-sea test tree to provide dual valve protection in the production bore, whereas the annulus bore is used to provide access into the well annulus and an auxiliary bore is used to provide a facility for receiving an electrical power cable for driving a electrical submersible pump. In the situation where a power cable is provided through, an additional bore is necessary to allow the installation of the electric power cable for an ESP. This enables the simplified xmas tree to provide all of the functions of a traditional xmas tree. In addition, the xmas tree can be readily assembled or the tree cap removed from the xmas tree to receive a BOP stack for use in the workover mode. A further advantage is that the dual valve xmas tree insert provides well barriers in accordance with statutory offshore requirements.

What is claimed is:

1. A xmas tree for use in a variety of well applications, said xmas tree comprising:

a generally cylindrical xmas tree housing defining a generally cylindrical bore, a separate xmas tree valve block disposed within the cylindrical bore of said xmas tree housing and engaged with the xmas tree housing, and a xmas tree cap for engaging with one of said valve block, and said xmas tree housing, the xmas tree cap being coupled to a rig via various flowline and umbilical services to facilitate control of the xmas tree in conveying fluids between surface mounted process facility and a downhole reservoir, the xmas tree valve block having a main production bore and at least one auxiliary bore, the main production bore having at least two valves axially spaced therein, said valves being operable to seal the main production bore and provide well barriers, said at least one auxiliary bore providing an annulus access bore and containing a single valve operable to seal the access bore and provide a well barrier in the annulus access bore.

2. A xmas tree as claimed in claim 1 wherein the xmas tree valve block has a main production bore and two auxiliary bores.

3. A xmas tree as claimed in claim 2 wherein one auxiliary bore provides the annulus access bore and has a valve therein and the other auxiliary bore has no valve but is used for receiving a power cable for driving an electrical submersible pump.

4. A xmas tree as claimed in claim 3 wherein the housing engages with a standard wellhead connector to enable it to be attached to a sub-sea wellhead and the valve block is proportioned and dimensioned to fit in within the bore of the housing and the housing is adapted to be received by the tree cap so that connection is made between parts of the production bore, and parts of the two auxiliary bores to provide effective connection for these bores.

5. A xmas tree as claimed in claim 4 wherein the connections in the production and annulus bore are provided by hollow pin and socket connections.

6. A xmas tree as claimed in claim 2 wherein if no power cable is used one auxiliary bore is blocked and the other auxiliary bore is provided with a valve for annulus control.

7. A xmas tree as claimed in claim 1 wherein said at least two axially spaced valves in the production bore are ball valves.

8. A xmas tree as claimed in claim 1 wherein said valves are flapper valves, disc valves or plug valves.

9. A xmas tree as provided in claim 1 wherein separate locking means are provided between the xmas tree housing and the valve block assembly which are actuated when the tree cap fits on to the valve block to lock the valve block to the xmas tree housing, and to provide fine alignment between the tree cap and the housing.

10. A xmas tree as claimed in claim 9 wherein the locking means are radially acting dogs which are actuated by axial movement of a ring within the locking means.

11. A xmas tree as claimed in claim 1 wherein an external surface of the upper end of an valve block is provided with at least one shaped keyway to ensure correct angular alignment between the xmas tree and the tree cap to facilitate correct engagement of various connections at the top surface of the tree cap.

12. A xmas tree as claimed in claim 1 wherein the xmas tree housing is coupled to a guide frame which is adapted to guide and receive the tree cap when installed to facilitate coupling between the tree cap and the tree housing and valve block.

13. A xmas tree as claimed in claim 12 wherein there is provided a permanent guide base, attached to the wellhead system, including a side guide frame with guidepost spacing of the same dimensions as the guide frame coupled to the wellhead so that when the tree cap is removed for workover mode, the tree cap can be moved to one side and parked adjacent to the wellhead.

14. A xmas tree structure comprising:

a xmas tree housing coupled to a sub-sea wellhead;

a xmas tree valve block located in said xmas tree housing, said xmas tree valve block having a production bore with at least two valves disposed in series and at least one auxiliary bore for facilitating annulus access control, said at least one auxiliary bore having a valve therein, a xmas tree cap coupled to the xmas tree valve block and to said xmas tree housing, locking means disposed in said xmas tree to fasten the xmas tree housing, xmas tree valve block and said xmas tree cap together, said respective xmas tree valves being remotely operable to be selectively moved between an open and a closed position to control flow of liquid through said xmas tree structure.

15. A xmas tree structure as claimed in claim 14 wherein there are two auxiliary bores; one being an annulus access bore with at least one valve therein and the other auxiliary bore for receiving a power cable for supplying power to a downhole electrical submersible pump (ESP).

16. A method of installing the xmas tree on a wellhead for use in a variety of well tests, the tree housing having a blow-out preventer stack initially coupled thereto in place of a tree cap, said method comprising the steps or:

a) providing a xmas tree housing coupled to the wellhead, the xmas tree housing having a top part adapted to be coupled to the blow-out preventer connector, b) running a xmas tree valve assembly through said blow out preventer stack for engaging with the xmas tree housing and being operable for providing a well barrier to the flow of well fluid, c) closing the well barrier to provide well isolation once the xmas tree valve assembly is located in said xmas tree housing, d) removing the blow-out preventer stack from the xmas tree housing, e) running in a xmas tree cap and securing the xmas tree cap to the xmas tree housing and xmas tree valve assembly to provide coupling from production and annulus bores to the surface and from auxiliary ports and bore to the surface, the arrangement being such that the valves in the production and annulus bores can be controlled to provide control of well fluid and xmas tree functionality.

17. A method as claimed in claim 16 wherein the method includes the step of using the xmas tree in a workover mode, said method including the additional steps of removing the xmas tree cap and parking the xmas tree cap on a further guide frame adjacent to the wellhead and xmas tree housing, and coupling the blow-out preventer stack on top of said xmas tree housing with said xmas tree assembly contained therein.

* * * * *